United States Patent [19]

Saarinen

[11] 3,987,955

[45] Oct. 26, 1976

[54] BIPARTITE BOX AND BLANK FOR MANUFACTURING THE SAME

[75] Inventor: Martti Saarinen, Tampere, Finland

[73] Assignee: Oy Tampella AB, Finland

[22] Filed: Sept. 24, 1975

[21] Appl. No.: 616,243

[30] Foreign Application Priority Data

Sept. 27, 1974 Finland ..... 2829/74

[52] U.S. Cl. ..... 229/20; 229/11; 229/51 TS

[51] Int. Cl.[2] ..... B65D 5/38

[58] Field of Search ..... 229/9, 10, 11, 19, 20, 229/51 DB, 51 TS

[56] References Cited

UNITED STATES PATENTS

| | | | |
|---|---|---|---|
| 1,185,560 | 5/1916 | Walcutt | 229/20 |
| 1,621,451 | 3/1927 | Beach | 229/11 |
| 1,906,742 | 5/1933 | Coulapides | 229/10 |
| 1,928,889 | 10/1933 | Guyer | 229/20 |
| 2,930,518 | 3/1960 | Cottrill | 229/51 TS |
| 2,936,944 | 5/1960 | Moore | 229/34 R |
| 2,990,994 | 7/1961 | Hackmyer | 229/19 |
| 3,231,170 | 1/1966 | Robinson | 229/20 |
| 3,346,167 | 10/1967 | Schmidt | 229/20 |

FOREIGN PATENTS OR APPLICATIONS

| | | | |
|---|---|---|---|
| 1,934,359 | 7/1969 | Germany | |
| 338,533 | 3/1936 | Italy | 229/19 |

*Primary Examiner*—William Price
*Assistant Examiner*—Bruce H. Bernstein
*Attorney, Agent, or Firm*—Steinberg & Blake

[57] ABSTRACT

A bipartite box as well as a blank for manufacturing the same. The box has an outer tubular guide and an inner container surrounded by the tubular guide and supported and guided for movement by the latter. The tubular guide has one open end and at an opposed end a tear strip which at least initially extends across this opposed end of the tubular guide, the tear strip having opposed edges one of which is connected with a wall of the tubular guide and the other of which is connected with an end wall of the inner container. The blank for the inner container as well as the outer tubular guide consists of a single body of sheet material having the portions which respectively form the inner container and the outer tubular guide interconnected by the tear strip. When the box is manufactured the tear strip can be removed immediately after the box is formed, even prior to filling of the inner container, or the inner container may first be filled and then closed while the tear strip remains connected with the container and the tubular guide therefor, so that the inner container will be released for movement with respect to the tubular guide only upon removal of the tear strip. Thus in this case removal of the gear strip will enable the inner container to be displaced with respect to the tubular guide to give access to the material in the inner container.

11 Claims, 7 Drawing Figures

BIPARTITE BOX AND BLANK FOR MANUFACTURING THE SAME

BACKGROUND OF THE INVENTION

The invention relates to boxes as well as to blanks from which the boxes are made.

In particular, the present invention relates to bipartite boxes as well as blanks for manufacturing the same, these particular bipartite boxes being of the type which has an inner container and an outer tubular guide surrounding the inner container and supporting the latter for movement with respect to the outer tubular guide.

The bipartite box of the invention may be made of any suitable sheet material such as cardboard, corrugated cardboard or other sheet material. This bipartite box of the invention consists of an outer jacket-like part which is of a tubular configuration and which surrounds and supports for movement the inner container which is of a box-like construction and which is intended to be totally or partly withdrawn from the outer tubular part when materials are removed from the box or added thereto.

The invention relates in particular to a bipartite box wherein the inner container and outer tubular guide are at least initially detachably connected with each other.

Boxes of this latter general type have already been proposed. For example, in this connection reference may be made to the German publication OS (Offenlegungschrift) No. 1,934,359. However, such previously known boxes have a disadvantage in that when the inner container part and the outer tubular guide are displaced one with respect to the other, there is unavoidably produced at a side of the inner container an opening which results in a direct permanent communication between the interior of the inner container and the outer space. As a result, when it is desired to situate in the inner container a material such as a fine powder or other granular material, such goods easily becomes unavoidably and undesirably emptied from the box through the permanent communication of the interior of the container with the outer atmosphere.

Moreover, the external appearance of such a box suffers inasmuch as one of the sides thereof is incomplete.

SUMMARY OF THE INVENTION

It is accordingly a primary object of the present invention to provide a bipartite box which will avoid the above drawbacks.

In particular, it is an object of the present invention to provide a bipartite box which can be manufactured from a single body of sheet material while at the same time providing for the possibility of situating in the interior container of the bipartite box a material which will not spill undesirably from the container after a tear strip interconnecting the inner container and outer tubular guide has been removed.

It is also an object of the present invention to provide a construction of the above type according to which it becomes possible to fill the inner container either prior to complete closing of the inner container while the tear strip is still attached to the inner container and the outer tubular guide or after removal of the tear strip when the inner container can be displaced with respect to the outer tubular guide so as to receive material.

It is an addition an object of the present invention to provide a bipartite box of the above general type which lends itself to various types of uses such as those wherein the inner container can be fully or partly open at one wall or where the inner container is initially fully closed with access being had thereto upon removal of a part of a wall thereof.

It is furthermore an object of the present invention to provide a construction of the above general type which is characterized by extreme simplicity and low cost both with respect to the material from which the bipartite box is made as well as with respect to the method of manufacture thereof.

According to the invention the inner container and outer tubular guide are connected with each other by way of a detachable tear strip which is joined with the inner container and the outer tubular part by way of lines of weakness situated at opposed edges of the tear strip, the inner container and outer tubular guide being separable from each other after the tear strip is removed along the lines of weakness.

The bipartite box of the invention is manufactured from a blank which consists of a single body of sheet material having portions which respectively form the inner container and the outer tubular guide therefor. These portions are joined to each other by way of the tear strip which has at opposed edges thereof lines of weakness. The blank is folded in such a way that the inner container becomes situated within the outer tubular guide while these components are still connected together by the tear strip, and the construction of the inner container is such that it can form a completely closed container or a container which is open at least at one side. The inner container and outer tubular guide can be detached from each other by removing the tear strip at the earliest after the bipartite box has initially been formed.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
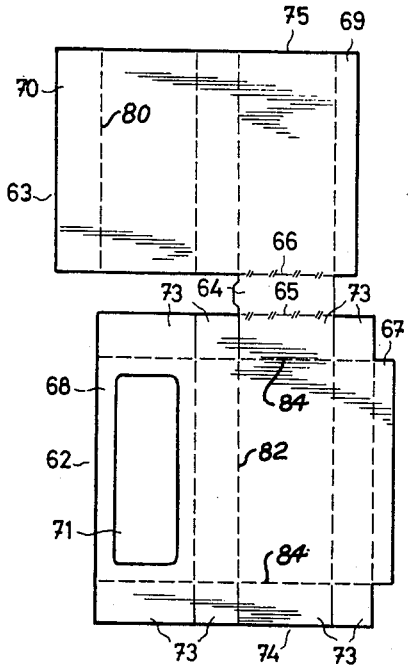
FIG. 1 illustrates the configuration of one possible blank from which the box of the invention is manufactured.

Referring to FIG. 1 of the drawings, there is illustrated therein a blank of the invention from which, according to a method of the invention, the bipartite box of the invention may be manufactured. The blank shown in FIG. 1 is made of a single body of sheet material such as a suitable cardboard or the like. The blank has a pair of portions 62 and 63 which are each of a substantially rectangular configuration as illustrated. The blank portion 62 is adapted to form the inner container 74 of the final box, while the blank portion 63 is adapted to form the outer tubular guide 75 of the final box. This blank portion 63 is provided with a plurality of parallel fold lines 80 along which the blank portion 63 is folded in order to form the tubular guide 75. The end strip 69 is glued or otherwise adhered to the portion 70 when forming the tubular guide 75 which is of rectangular cross section.

The blank portion 62 which forms the inner container 74 has a plurality of parallel fold lines 82 which extend between the transverse fold lines 84, and beyond these fold lines 84 are situated the end flaps 73 which are joined together in overlapping relation in order to form the end walls of the inner container. This blank portion 62 has an end strip 67 adapted to be glued to the left edge portion of the wall 68 when forming the inner container 74.

Figure 5:
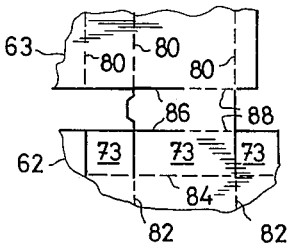
FIG. 5 is a fragmentary illustration of a variation in part of the blank structure of FIG. 1.

The blank portions 62 and 63 are joined to each other by way of a tear strip 64 which is integral with the blank portions 62 and 63, being joined thereto along a pair of lines of weakness 65 and 66. These lines of weakness 65 and 66 may take the form of lines of perforations as schematically illustrated in FIG. 1, or, as shown in FIG. 5, the tear strip 64 may be joined with the blank portions 62 and 63 by way of lines of weakness which are initially cut along the portions 86 while the remainder of the tear strip 64 is joined with the blank portions 62 and 63 by lines of perforations 88.

The bipartite box is formed from the blank of FIG. 1 by folding the blank portion 62 along the line 65 so that it overlies the blank portion 63. The distance between the pair of transverse fold lines 84 equals the distance between the upper and lower edges of the blank portions 63, as viewed in FIG. 1, so that when the blank portion 62 is folded along the line 65 to overlie the blank portion 63, the flaps 73 of the blank portion 62 project beyond the opposed upper and lower edges of the blank portion 63. After this initial folding along the line 65 has been performed, the inner container 74 is partially formed by folding the same along the lines 82, and the strip 67 is joined with the wall 68. Then the outer tubular guide 75 is formed by folding the blank portion 63 along the lines 80, and the strip 69 is joined to the wall 70. The structure will then have the condition shown in FIG. 2.

Figure 2:
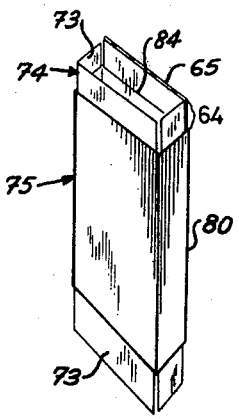
FIG. 2 illustrates the box formed from the blank of FIG. 1 at a stage just prior to closing the ends of the interior container.
Figure 3:
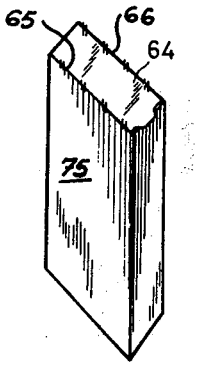
FIG. 3 is a perspective illustration of the completed box.

After the box has the condition shown in FIG. 2, the ends of the inner container can be closed by folding the flaps 73 together and joining them to each other. For example, at the lower end of the box as viewed in FIG. 2, one of the longer flaps 73 can first be folded inwardly, after which the shorter flaps can be folded across this inwardly folded longer flap and joined thereto, and then the remaining longer flap can be folded across the three previously joined flaps. Of course this sequence of joining of the flaps to each other can be altered as desired.

The same procedure is performed with the upper part of the box as viewed in FIG. 2, except that it is essential to make certain that the tear strip 64 is accessible at the exterior of the completed box. It will be noted that in the completed box the tear strip 64 is joined along one of its opposed side edges to one of the longer flaps 73 at one end of the inner container and at the other of its opposed edges to one of the walls of the tubular guide 75.

Figure 4:
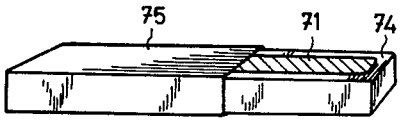
FIG. 4 shows the box during use when the inner container is displaced with respect to the outer tubular guide.
Figure 6:
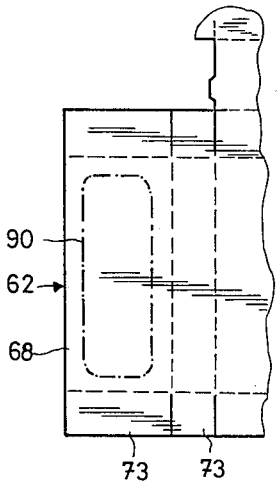
FIG. 6 is a fragmentary illustration of a further variation of part of the blank structure of FIG. 1.

In the particular example shown in FIG. 1, one of the walls of the blank portion 62, namely the wall 68, is initially formed with the relatively large opening 71 so that at this one wall the inner container will be almost fully open. Of course the size of the opening 71 can be varied as desired so that if desired a relatively small opening can be initially formed in the wall 68. However, it is also possible as shown in FIG. 6, to leave the wall 68 without any openings passing therethrough so that when the container 74 is completed it is fully closed. With such an arrangement, after one end of the inner container 74 is closed subsequent to the stage shown in FIG. 2, the container can be filled from the other end thereof which is still open, and then this other end can be closed. Thus with such an arrangement after the tear strip 64 is removed it is possible to slide the inner container with respect to the outer tubular guide so as to give access to the wall 68, and then an opening can be formed therein such as an opening extending along the line 90 indicated in FIG. 6. This line 90 may be printed on the sheet material so as to provide a guide for a knife or the like, or a line of perforations may extend along the line 90 to facilitate removal of a portion of the wall 68 after the tear strip 64 has been removed. With an arrangement as shown in FIG. 1 where an opening 71 is initially formed in the blank, it is possible to fill the inner container 74 either after one of the ends is closed or after the box has been fully completed and the tear strip removed, so that the inner container 74 can be shifted with respect to the outer guide 75 to give access through the opening 71 to the interior of the container 74 whereupon the latter may be filled with any desired material. The structure is shown in FIG. 4 in the condition where the inner container 74 has indeed been moved with respect to the outer tubular guide 75 after the tear strip 64 has been removed, so that access may be had to the interior of the inner container 74 through the opening 71.

Thus, according to the invention the inner container 74 and the outer tubular guide 75 are initially connected to each other by way of the tear strip 64 so that the parts 74 and 75 cannot be moved with respect to each other until the tear strip is removed. Such removal of the tear strip 64 may take place either when the box is manufactured or at a subsequent time. Thus if it is desired to produce a box where the inner part and the outer part are separable from each other when the box is completed, then the tear strip can be removed during manufacture of the box, such as at the filling machine.

However, if the tear strip 64 remains connected with the container 74 and outer tubular guide 75, then these components of the bipartite box remain connected to each other in the completed box, and they need not be separable from each other until the tear strip is removed, for example, by the final consumer who purchases the box with the contents therein. Thus with such an arrangement it is possible for the purchaser to assure himself that the materials contained within the box are situated in an original package which has not yet been opened.

It will be noted that with the box of the invention even after the tear strip has been removed, all four sides of the inner container and all parts of the outer tubular guide remain intact, with the result that:

a. when a fully closed box is made, it can be completely hermetically closed, which is a considerable advantage, for example in the packaging of hygroscopic products;

b. if it is desired for spraying or metering the materials, apertures can be made in the walls of the inner container and/or the outer tubular guide, and the location of these apertures as well as their size and shape can be selected with complete freedom; and c. a direct communication between the interior of the inner container 74 and the outer atmosphere is avoided even after the tear strip 64 has been removed, which is in sharp contrast with previously known constructions whereupon removal of the tear strip an unavoidable gap was provided permanently between the outer atmosphere and the interior of the inner container.

Thus, with the box of the invention it is possible to provide a package of relatively fine granular materials which cannot escape even after the tear strip is removed.

Moreover, the box of the invention has an attractive external appearance inasmuch as all sides of the box remain complete.

It is of course preferred to situate the tear strip 64 at the end of the box, as illustrated, inasmuch as with such a construction when the box is taken into one hand the end of the box is readily visible and accessible so that the tear strip can easily be removed.

Figure 7:
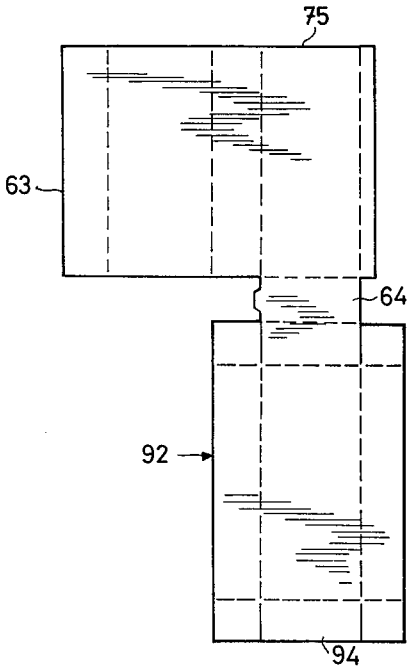
FIG. 7 illustrates a further embodiment of a blank according to the invention.

In the event that it is desired to have the inner container fully open at its top, then the embodiment of FIG. 7 will be used. According to this embodiment the portion 63 of the blank is identical with that of the other embodiments and forms the same outer tubular guide 75. However, instead of a blank portion 62 as shown in FIG. 1, for example, the blank of FIG. 7 has a blank portion 92 which forms the inner container of the bipartite box. This blank portion 92 is the same as the blank portion 62 except that the wall 68 of the latter has been omitted as well as flaps 73 at the end of the wall 68. Thus, with the embodiment of FIG. 7, the blank portion 92 will form an inner container 94 which is fully open at its top with the shorter end flaps only being joined to the longer end flaps at each end of the inner container, and of course the strip 67 of FIG. 1 is no longer required. The tear strip 64, however of the embodiment of FIG. 7 cooperates with the blank portions of this embodiment in the same way as the tear strips 64 of the other embodiments.

It is to be noted that the invention is not limited to the particular embodiments and details described above and shown in the drawings since various details can vary within the scope of the claims which follow. For example, between the blank portions 62 and 63 the lines of perforations at the tear strip 64 and the opening 71 may be varied with regard to their locations and lengths. Moreover, the opposed edges 65 and 66 of the tear strip 64 may take the form of simple score lines which form lines of weakness facilitating removal of the tear strip 64.

What is claimed is:

1. A bipartite box comprising an inner container and an outer tubular guide surrounding and engaging said inner container and supporting the latter for slidable movement with respect to said guide, said tubular guide being open at one end, and a tear strip extending across the other end of said tubular guide, said tear strip having a pair of opposed edges one of which is at least partly integral with a wall of said tubular guide at said other end thereof and the other of which is at least partly integral with an end wall of said inner container, whereby said tear strip connects said inner container with said outer tubular guide until said tear strip is removed.

2. The combination of claim 1 and wherein said tear strip is connected with said tubular guide and container by lines of weakness situated at said opposed edges of said tear strip.

3. The combination of claim 2 and wherein said lines of weakness are each formed at least in part by a line of perforations.

4. The combination of claim 1 and wherein said tear strip is at least in part separated from said tubular guide and container and at least in part connected thereto by lines of weakness.

5. The combination of claim 1 and wherein said inner container is at least initially fully closed.

6. The combination of claim 1 and wherein said inner container has a wall formed with an opening through which access is given to the interior of said inner container after removal of said tear strip.

7. The combination of claim 1 and wherein said inner container is initially substantially fully closed but has at one wall a portion removable from said one wall by way of a line of perforations or the like connecting said portion of said one wall to the remainder thereof.

8. A blank for forming a bipartite box having an inner container and an outer tubular guide therefor, said blank consisting of a single body of sheet material having a pair of blank portions one of which is of substantially rectangular configuration and is adapted to form the tubular guide and the other of which also is of substantially rectangular configuration and is adapted to form the container, the latter blank portion having flaps to be joined together for forming end walls of said container, and a tear strip forming part of said body of sheet material and being integral with and extending between said one blank portion and one of said flaps of said other blank portion.

9. The combination of claim 8 and wherein said tear strip is joined with said blank portions by lines of weakness.

10. The combination of claim 9 and wherein said lines of weakness are formed by lines of perforations.

11. The combination of claim 10 and wherein said lines of perforations extend along only part of the length of said tear strip at opposed side edges thereof while the remainder of said tear strip is separated from said blank portions.

* * * * *